US008094106B2

(12) United States Patent
Huang et al.

(10) Patent No.: US 8,094,106 B2
(45) Date of Patent: Jan. 10, 2012

(54) FLAT PANEL DISPLAY

(75) Inventors: Wei-Kai Huang, Tainan (TW); Chia-Chiang Lin, Changhua County (TW)

(73) Assignee: Au Optronics Corporation, Hsinchu (TW)

( * ) Notice: Subject to any disclaimer, the term of this patent is extended or adjusted under 35 U.S.C. 154(b) by 403 days.

(21) Appl. No.: 12/505,546

(22) Filed: Jul. 20, 2009

(65) Prior Publication Data

US 2010/0201607 A1 Aug. 12, 2010

(30) Foreign Application Priority Data

Feb. 11, 2009 (TW) ..... 98104327 A

(51) Int. Cl.
*G09G 3/36* (2006.01)

(52) U.S. Cl. ..... 345/87; 345/55

(58) Field of Classification Search ..... 345/55, 345/82, 76, 87; 324/770
See application file for complete search history.

(56) References Cited

U.S. PATENT DOCUMENTS

| | | | | |
|---|---|---|---|---|
| 5,714,770 | A | 2/1998 | Kim | |
| 7,021,808 | B2 * | 4/2006 | Currie et al. | 362/551 |
| 7,234,828 | B2 * | 6/2007 | Kelly et al. | 362/84 |
| 2002/0053095 | A1 * | 5/2002 | Brown et al. | 800/278 |
| 2010/0201903 | A1 * | 8/2010 | Huang et al. | 349/55 |

FOREIGN PATENT DOCUMENTS

TW 200739181 10/2007

* cited by examiner

*Primary Examiner* — Ricardo L Osorio
(74) *Attorney, Agent, or Firm* — Jianq Chyun IP Office

(57) ABSTRACT

A flat panel display includes a display panel and a control circuit. The display panel has a display area and a peripheral area. Besides, the display panel includes a pixel array, signal lines, first rescue lines, second rescue lines, and an adjustable load. The pixel array is located in the display area, and the signal lines extend from the display area to the peripheral area and electrically connect the pixel array. The first rescue lines, the second rescue lines, and the adjustable load are disposed in the peripheral area. Each of the second rescue lines crosses an end of one of the signal lines, and the adjustable load is electrically connected with the first rescue lines. The control circuit includes a driving unit and a rescue unit. The driving unit is electrically connected with the signal lines, and the rescue unit is electrically connected with the first rescue lines.

20 Claims, 3 Drawing Sheets

FLAT PANEL DISPLAY

CROSS-REFERENCE TO RELATED APPLICATION

This application claims the priority benefit of Taiwan application serial no. 98104327, filed on Feb. 11, 2009. The entirety of the above-mentioned patent application is hereby incorporated by reference herein and made a part of specification.

BACKGROUND OF THE INVENTION

1. Field of the Invention

The present invention relates to a flat panel display (FPD). More particularly, the present invention relates to an FPD having an adjustable load.

2. Description of Related Art

In an FPD, two sets of perpendicular address lines are used to control pixels arranged in array, so as to display images. Among various display control modes, scan lines and data lines perpendicular to each other are most commonly employed, and the scan lines and the data lines define a plurality of pixels. Each of the scan lines is turned on sequentially, so as to switch on or switch off corresponding switching elements and allow signals transmitted by each of the data lines to be written into the pixels. Thereby, the state of the corresponding pixels can be changed, and the images displayed can be controlled.

Even though the FPD technology gradually tends to be mature, defects unavoidably occur during the fabrication of a display panel. Besides, both the scan lines and the data lines cross through the entire display panel, and therefore the significant total length of the scan lines and the data lines easily results in broken lines. When the scan lines and the data lines formed on a base are broken, parts of the pixels cannot be operated (i.e., line defects). Hence, it is necessary to repair the broken lines, or the display panel is discarded. In addition, it is rather difficult to fabricate the display panel without generating any defects merely by improving the manufacturing process. As a result, techniques of repairing the defects formed in the display panel turn out to be indispensable. According to the pertinent art, defects of the display panel are frequently repaired by laser welding and/or laser cutting.

A conventional FPD not only has a plurality of scan lines and a plurality of data lines perpendicular to each other but also has a rescue unit frequently equipped with a plurality of rescue lines. Under normal circumstances, the rescue lines extend across but not electrically connect the data lines or the scan lines. Nonetheless, when the data lines are damaged, the rescue lines are used for repairing the data lines. For instance, when a damaged data line on the FPD is detected, two ends of the damaged data line and two of the rescue lines crossing the two ends of the damaged data line can be welded respectively, such that the damaged data line is electrically connected with the rescue unit through the rescue lines and is then repaired. In some cases, the rescue unit can further have a buffer element for repeating received signals and transmitting the repeated signals in the original signal levels.

However, different broken positions of the data lines result in different loads, such that weak bright lines or weak dark lines generate. For example, the farther a distance from a broken position of a data line to an initial position where the data signals are transmitted is, the greater the load caused by the data line is; the closer the distance from the broken position of the data line to the initial position where the data signals are transmitted is, the less the load caused by the data line is. Both the weak bright line and the weak dark line negatively affect the quality of images which are displayed on the FPD. To resolve said issue, a fixing resistor is often electrically connected with the buffer element, so as to mitigate the influence posed by different loads due to the different broken positions of the data lines.

With the increasing dimension of the FPD, however, the length of the data lines on the display panel becomes greater and greater. As such, the issue with respect to different loads due to the different broken positions of the data lines can no longer be effectively resolved by disposing the fixing resistor as discussed above. If different fixing resistors are respectively disposed according to the different broken positions of the data lines, complexity of product and material management is raised, and so are the inventory costs and the entire production costs. Therefore, it has been proposed that the buffer element is electrically connected with a variable resistor or capacitor. Based on different broken positions of the data lines, the load can be tuned by utilizing the variable resistor or capacitor, and the weak bright line or the weak dark line caused by different loads (due to the different broken positions of the data lines) can be better prevented.

Notwithstanding the above, stability and reliability of the display quality are reduced because tolerance of manufacturing passive elements including the variable resistor or capacitor cannot be neglected. Moreover, additionally passive elements are required, and therefore manufacturers should afford additional costs when manufacturing the entire product. Further, an additional process is necessitated by electrically connecting the passive elements to a circuit board, which is unfavorable to reduction of costs, simplification of production, and integration of fabricating processes.

As a result, it has become one of the major concerns to provide an FPD in which broken lines can be repaired and load can be tuned properly upon different broken positions of the data lines. Thereby, quality of repairing broken lines in the FPD can be improved, elements can be further integrated, fabrication can be simplified, and manufacturing costs can be lowered down.

SUMMARY OF THE INVENTION

The present invention is directed to an FPD in which a display panel has an adjustable load.

The present invention provides an FPD having a display panel and a control circuit. The display panel has a display area and a peripheral area. Besides, the display panel includes a pixel array, a plurality of signal lines, a plurality of first rescue lines, a plurality of second rescue lines, and an adjustable load. The pixel array is located in the display area. The signal lines are electrically connected with the pixel array, and the signal lines extend from the display area to the peripheral area. The first rescue lines are located in the peripheral area. The second rescue lines are located in the peripheral area, and each of the second rescue lines crosses an end of one of the signal lines. The adjustable load is located in the peripheral area and electrically connected with the first rescue lines. The control circuit is electrically connected with the signal lines and the first rescue lines. In addition, the control circuit includes a driving unit and a rescue unit. The driving unit is electrically connected with the signal lines, and the rescue unit is electrically connected with the first rescue lines.

According to an embodiment of the present invention, the signal lines of the FPD include a plurality of scan lines, a plurality of first fan-out traces, a plurality of data lines, and a plurality of second fan-out traces. The first fan-out traces are located in the peripheral area and connected with the scan lines. The data lines extend across the scan lines, and the data lines are located in the peripheral area. The second fan-out traces are located in the peripheral area and connected with the data lines.

According to an embodiment of the present invention, the rescue unit of the FPD further includes an invariable load electrically connected with a buffer element and the first rescue lines.

Based on the above, the FPD of the present invention is equipped with the adjustable load and capable of flexibly adjusting the value of the load, so as to prevent the weak bright line or the weak dark line. Moreover, fabrication of the adjustable load is integrated into a thin film deposition process of the display panel, and therefore the common issue regarding tolerance of externally connecting passive elements does not occur, such that stability and reliability of the load can be improved, the manufacturing costs can be reduced, the fabricating process can be simplified, complexity of product and material management can be reduced, and products can be better integrated.

In order to make the aforementioned and other features and advantages of the present invention more comprehensible, several embodiments accompanied with figures are described in detail below.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DESCRIPTION OF EMBODIMENTS

Note that detailed structures provided in the following embodiments as examples can all be combined, replaced, or omitted under reasonable circumstances, so as to comply with actual demands. After referring to the descriptions in the following embodiments, a person having ordinary skill in the art should be able to comprehend the spirit and features of the present invention and make practical modifications and applications without departing from the spirit of the invention and in a manner consistent with the scope of the invention. Besides, to facilitate illustration and comprehension of the disclosure, same reference numbers are used to represent same or similar elements, and repetitive explanation is likely to be omitted.

Figure 1:
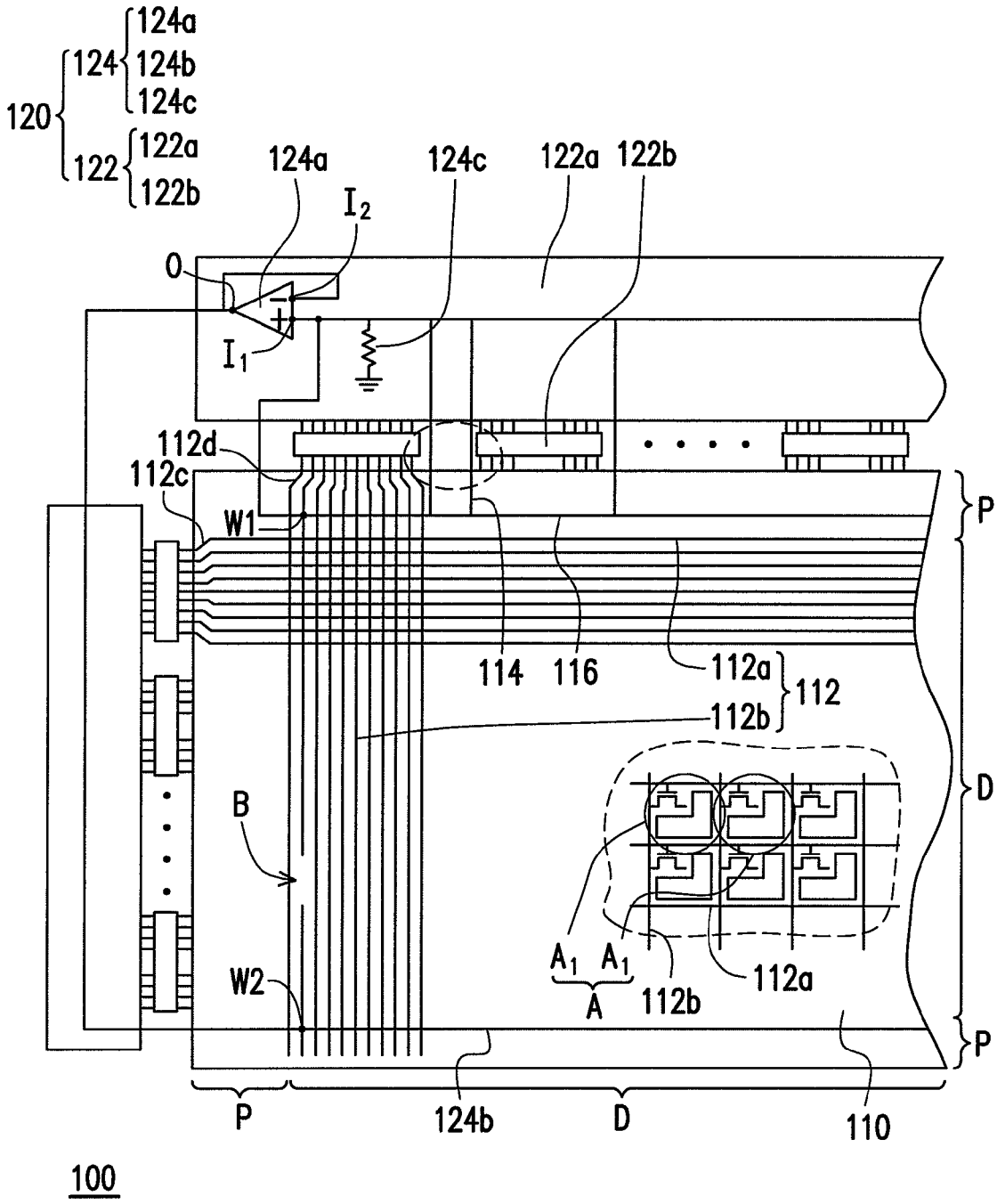
FIG. 1 is a schematic view of an FPD according to an embodiment of the present invention.
Figure 2:
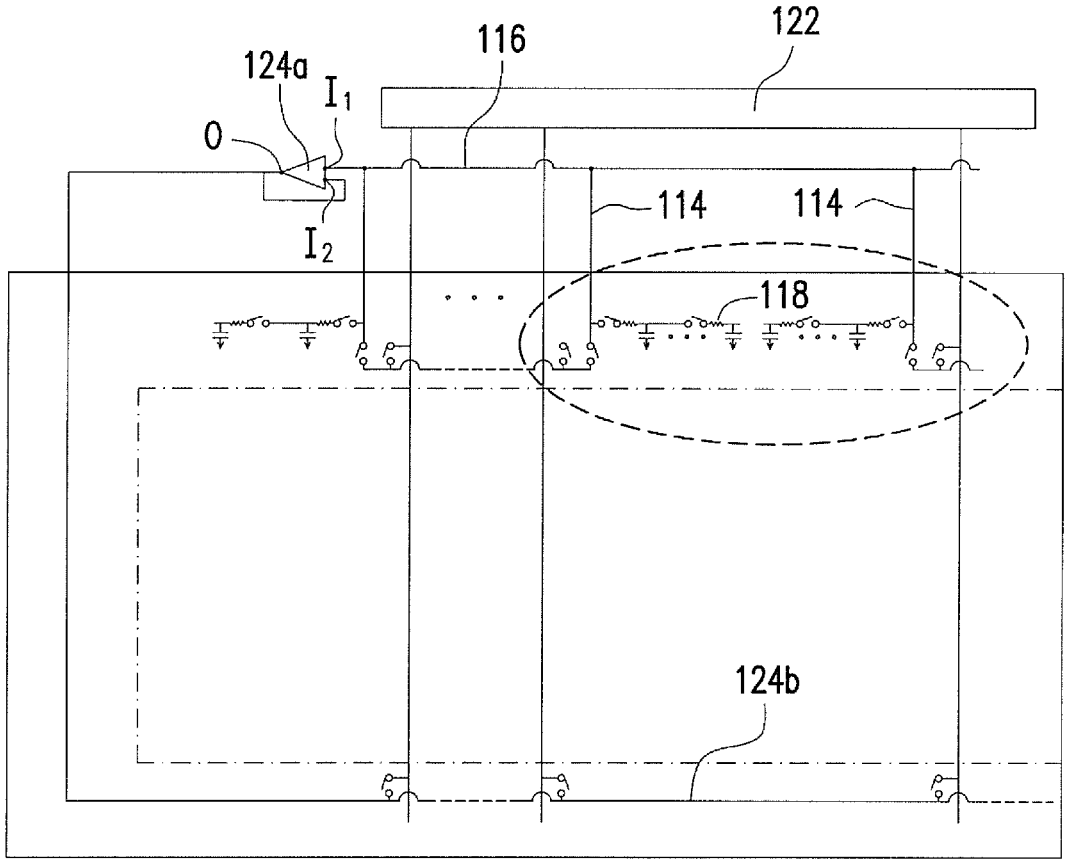
FIG. 2 is an equivalent circuit diagram of FIG. 1.
Figure 3:
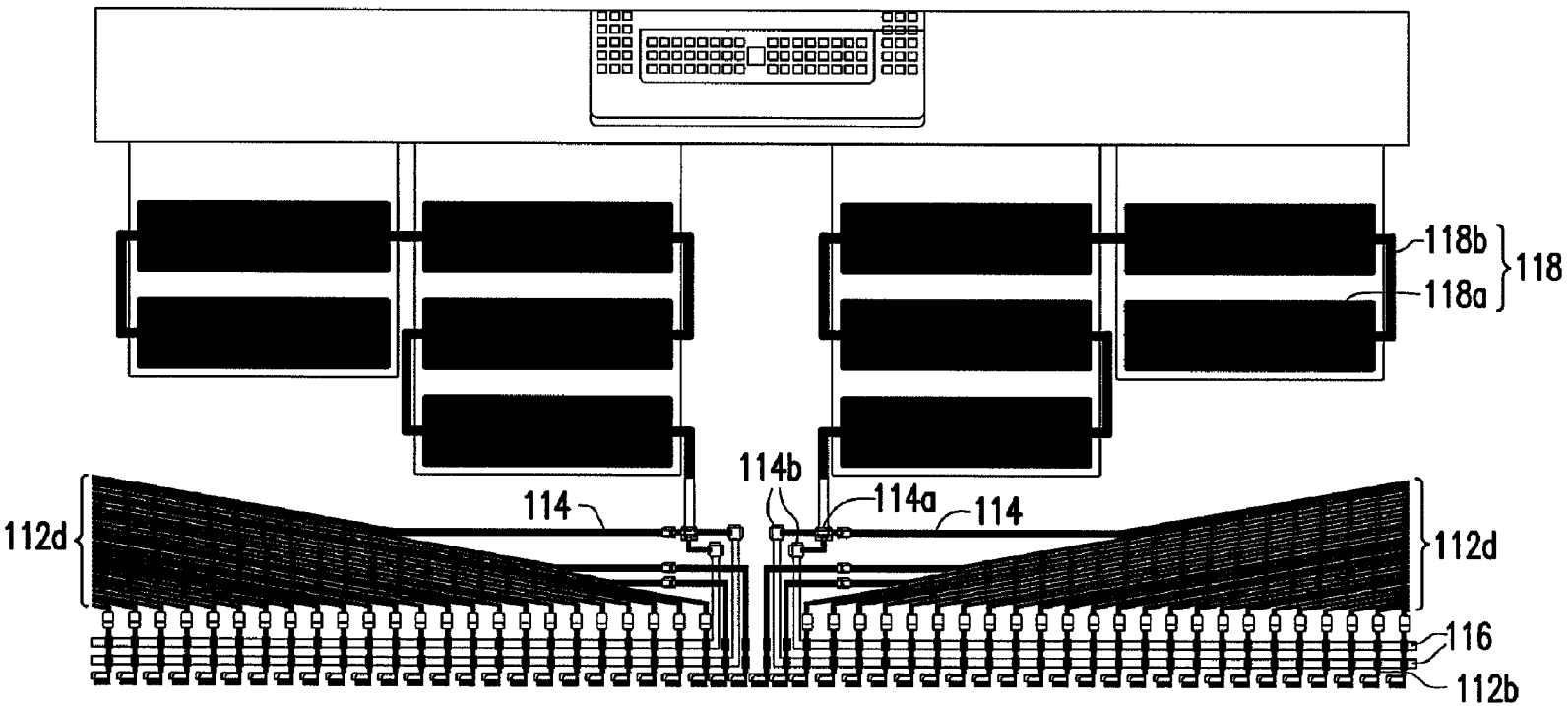
FIG. 3 is a partially enlarged schematic view of FIG. 1.

FIG. 1 is a schematic view of an FPD according to an embodiment of the present invention. FIG. 2 is an equivalent circuit diagram of FIG. 1. FIG. 3 is a partially enlarged schematic view of FIG. 1. Referring to FIGS. 1 to 3, the FPD 100 of the present invention includes a display panel 110 and a control circuit 120. The display panel 110 can be divided into a display area D and a peripheral area P. The peripheral area P substantially surrounds the display area D or adjoins at least one side of the display area D. Besides, the display panel 110 includes a pixel array A, a plurality of signal lines 112, a plurality of first rescue lines 114, a plurality of second rescue lines 116, and an adjustable load 118. According to the present embodiment, the display panel 110 is a liquid crystal display panel. In other embodiments, the display panel 110 can also be a plasma display panel, a field emission display panel, an electro-luminescence (EL) display panel, or other types of display panels.

The pixel array A is located in the display area D of the display panel 110. The signal lines 112 are electrically connected with the pixel array A and extend from the display area D to the peripheral area P.

Referring to FIGS. 1 and 3, in the present embodiment, the signal lines 112 include a plurality of scan lines 112*a*, a plurality of data lines 112*b*, a plurality of first fan-out traces 112*c*, and a plurality of second fan-out traces 112*d*. The first fan-out traces 112*c* are located in the peripheral area P and connected with the scan lines 112*a*. The second fan-out traces 112*d* are located in the peripheral area P and connected with the data lines 112*b*. The data lines 112*b* extend across the scan lines 112*a*.

Based on the above, the first rescue lines 114, the second rescue lines 116, and the adjustable load 118 are all located in the peripheral area P. Each of the second rescue lines 116 crosses an end of one of the signal lines 112, and the second rescue lines 116 can be electrically connected with the first rescue lines 114 by laser welding second ends 114*b* of the first rescue lines 114, for example, as shown in FIG. 3. In the present embodiment, first ends 114*a* of the first rescue lines 114 are connected with the adjustable load 118, and the first rescue lines 114 are connected with a rescue unit 124. In addition, the second fan-out traces 112*d* are divided into a plurality of groups, and the adjustable load 118 can be disposed between two of the adjacent groups.

According to the present embodiment, the second rescue lines 116, the scan lines 112*a*, and the first fan-out traces 112*c* are, for example, in the same patterned conductive layer. The first rescue lines 114, the data lines 112*b*, and the second fan-out traces 112*d* are, for example, in the same patterned conductive layer. The first rescue lines 114 and the second rescue lines 116 belong to different patterned conductive layers, for example. Note that the conductive wires can be distributed in other manners, which should not be construed as limited to the present invention.

The adjustable load 118 formed on the display panel 110 can be a resistor, a capacitor, or a combination thereof according to the present invention. In the present embodiment, the adjustable load 118 is constituted by a plurality of capacitors 118*a* and a plurality of connection lines 118*b*. The capacitors 118*a* are connected by the connection lines 118*b*, such that the capacitors 118*a* are connected in parallel, as indicated in FIG. 3.

The control circuit 120 is electrically connected with the signal lines 112 and the first rescue lines 114. For instance, the signal lines 112 and the first rescue lines 114 are connected during fabrication thereof. Alternatively, after the damaged signal lines 112 or defects generated therein are detected, the signal lines 112 and the first rescue lines 114 can be connected by laser welding, for example. Here, the control circuit 120 includes a driving unit 122 and a rescue unit 124. The driving unit 122 is electrically connected with the signal lines 112. According to the present embodiment, the driving unit 122 includes a control circuit board 122*a* and a plurality of driving units 122*b*. After repair, the driving units 122*b* are electrically connected with the control circuit board 120, the signal lines 112, and the first rescue lines 114. The driving units 122*b* refer to chip-on-film (COF) packages electrically connected between the control circuit board 122*a* and the display panel 110. By contrast, in other embodiments of the present invention, the driving units 122*b* can also refer to tape automated bonding (TAB) packages or other types of driving unit packages. It should be noted that the driving units 122*b* are not limited to be disposed between the control circuit board 122*a* and the display panel 110 in the present invention. Namely, the driving units 122*b* can also be disposed on the display panel 110 or on the control circuit board 122*a*.

As shown in FIG. 1, the rescue unit 124 is electrically connected with the first rescue lines 114. In the present embodiment, the rescue unit 124 is located and formed on the control circuit board 122*a* and can further include a buffer element 124*a* and a third rescue line 124*b*. The buffer element 124*a* of the present embodiment is an amplifier and has a first input end I1, a second input end I2, and an output end O. The first input end I1 is electrically connected with the first rescue lines 114, and the second input end I2 is electrically connected with the output end O. The third rescue line 124*b* can be located in the peripheral area P and crosses the other end of each of the signal lines 112, respectively. Since the amplifier is disposed on a transmission path of the rescue unit 124, signals transmitted through the second rescue liens 116 or the third rescue line 124*b* can be amplified, and thereby an issue of signal decay after a long-distance transmission can be overcome.

In the present embodiment, the rescue unit 124 can further include an invariable load 124*c* electrically connected with the buffer element 124*a* and the first rescue lines 114. The invariable load 124*c* is, for example, a resistor, a capacitor, or an inductor. The invariable load 124*c* may be used for reducing unexpected effect occurred from different locations of broken lines which results different loads.

When the signal lines 112 are not broken, the signal lines 112 respectively extend across but not connect the second rescue lines 116 or the third rescue line 124*b*. That is to say, the signal lines 112 are electrically isolated from the second rescue lines 116 or the third rescue line 124*b*. Here, the signal lines 112 are electrically connected with the driving unit 122, and data signals are transmitted to each pixel unit through the driving units 122*b*. Thereby, display effects can be achieved by the pixel units.

Given that there is a broken line B in the signal lines 112, as shown in FIG. 1, the former half of signal lines 112 are electrically connected with the second rescue lines 116 at a first welding portion W1 by laser welding. Additionally, the latter half of signal lines 112 are electrically connected with the third rescue line 124*b* at a second welding portion W2 by laser welding. In other words, the former half of signal lines 112 and the latter half of signal lines 112 can be electrically connected through the first welding portion W1, the second rescue lines 116, the second welding portion W2, and the third rescue line 124*b*.

Referring to FIGS. 1 to 3, after the former half of signal lines 112 and the second rescue lines 116 are electrically connected at the first welding portion W1, and the latter half of signal lines 112 and the third rescue line 124*b* are electrically connected at the second welding portion W2, the value of the adjustable load 118 can be adjusted based on different positions of the broken lines. In the present embodiment, the value of the adjustable load 118 can be adjusted by laser cutting the connection lines 118*b* of the adjustable load 118, such that the signal lines 112 can have an appropriate load value. Thereby, weak bright line or weak dark line can be prevented, and the display quality as a whole can be improved.

In light of the foregoing, formation of the adjustable load is integrated into a thin film metal deposition process according to the present invention, and therefore the common issue regarding tolerance of externally connecting passive elements does not occur, such that stability and reliability of the load can be improved. Moreover, fabrication of the adjustable load is integrated into a thin film deposition process of the display panel. Hence, manufacturers are not burdened with costs of and time spent on fabricating the adjustable load. As such, the manufacturing costs can be reduced, the fabricating process can be simplified, and products can be better integrated.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A flat panel display, comprising:

a display panel having a display area and a peripheral area, the display panel comprising:

a pixel array disposed in the display area;

a plurality of signal lines electrically connected with the pixel array and extending from the display area to the peripheral area;

a plurality of first rescue lines located in the peripheral area;

a plurality of second rescue lines located in the peripheral area; and an adjustable load located in the peripheral area; and a control circuit electrically connected with the signal lines and the first rescue lines; the control circuit comprising:

a driving unit electrically connected with the signal lines; and a rescue unit electrically connected with the first rescue lines.

2. The flat panel display as claimed in claim 1, wherein the signal lines comprise:

a plurality of scan lines;

a plurality of first fan-out traces located in the peripheral area and connected with the scan lines;

a plurality of data lines extending across the scan lines; and a plurality of second fan-out traces located in the peripheral area and connected with the data lines.

3. The flat panel display as claimed in claim 2, wherein the second rescue lines, the scan lines, and the first fan-out traces belong to a patterned conductive layer.

4. The flat panel display as claimed in claim 2, wherein the first rescue lines, the data lines, and the second fan-out traces belong to a patterned conductive layer.

5. The flat panel display as claimed in claim 1, wherein a first end of each of the first rescue lines is connected with the adjustable load, and a second end of each of the first rescue lines is connected with one of the second rescue lines.

6. The flat panel display as claimed in claim 1, wherein a first end of each of the first rescue lines is located above and isolated from one of the second rescue lines.

7. The flat panel display as claimed in claim 1, wherein the first rescue lines belong to a patterned conductive layer, and the second rescue lines belong to another patterned conductive layer.

8. The flat panel display as claimed in claim 1, wherein the adjustable load comprises a resistor or a capacitor.

9. The flat panel display as claimed in claim 1, wherein the adjustable load comprises:

a plurality of capacitors; and a plurality of connection lines connected with the capacitors, wherein the capacitors are connected in parallel.

10. The flat panel display as claimed in claim 1, wherein the second fan-out traces are divided into a plurality of groups, and the adjustable load is located between two of the adjacent groups.

11. The flat panel display as claimed in claim 1, wherein the control circuit comprises:

a control circuit board; and a plurality of driving units electrically connected with the control circuit board, the signal lines, and the first rescue lines.

12. The flat panel display as claimed in claim 11, wherein the rescue unit is located on the control circuit board.

13. The flat panel display as claimed in claim 11, wherein the driving units are chip on film (COF) packages or tape automated bonding (TAB) packages.

14. The flat panel display as claimed in claim 11, wherein the driving units are disposed on the control circuit board.

15. The flat panel display as claimed in claim 11, wherein the driving units are disposed on the display panel.

16. The flat panel display as claimed in claim 1, wherein the rescue unit comprises:

a buffer element; and a third rescue line located in the peripheral area and connected with the buffer element, wherein the third rescue line crosses the other end of each of the signal lines, respectively.

17. The flat panel display as claimed in claim 16, wherein the buffer element comprises an amplifier.

18. The flat panel display as claimed in claim 17, wherein the amplifier has a first input end, a second input end, and an output end, the first input end is electrically connected with one of the first rescue lines, and the second input end is electrically connected with the output end.

19. The flat panel display as claimed in claim 16, wherein the rescue unit further comprises an invariable load electrically connected with the buffer element and the first rescue lines.

20. The flat panel display as claimed in claim 1, wherein the adjustable load is electrically connected with the first rescue lines.

* * * * *